US009944079B2

(12) United States Patent
Choy et al.

(10) Patent No.: US 9,944,079 B2
(45) Date of Patent: Apr. 17, 2018

(54) PRINT BAR STRUCTURE

(71) Applicant: HEWLETT-PACKARD DEVELOPMENT COMPANY, L.P., Houston, TX (US)

(72) Inventors: Silam Choy, Corvallis, OR (US); Rhonda Lynn Wilson, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 15/326,244

(22) PCT Filed: Jul. 17, 2014

(86) PCT No.: PCT/US2014/047085
§ 371 (c)(1),
(2) Date: Jan. 13, 2017

(87) PCT Pub. No.: WO2016/010543
PCT Pub. Date: Jan. 21, 2016

(65) Prior Publication Data
US 2017/0203565 A1 Jul. 20, 2017

(51) Int. Cl.
*B41J 2/15* (2006.01)
*B41J 2/145* (2006.01)

(52) U.S. Cl.
CPC ..... *B41J 2/145* (2013.01)

(58) Field of Classification Search
CPC ..... B41J 2/155; B41J 2/145; B41J 2202/20
USPC ..... 347/40, 44, 47, 49
See application file for complete search history.

(56) References Cited

U.S. PATENT DOCUMENTS

| | | | | |
|---|---|---|---|---|
| 7,425,053 | B2 * | 9/2008 | Silverbrook | B41J 2/04 347/42 |
| 7,566,126 | B2 | 7/2009 | Ha et al. | |
| 8,205,965 | B2 | 6/2012 | Scheffelin et al. | |
| 8,235,484 | B2 | 8/2012 | Ray et al. | |
| 8,517,508 | B2 | 8/2013 | Amidon et al. | |
| 8,967,769 | B1 * | 3/2015 | Dowell | B41J 2/155 347/40 |
| 2005/0156981 | A1 | 7/2005 | Silverbrook et al. | |
| 2006/0007276 | A1 | 1/2006 | Silverbrook | |
| 2007/0087071 | A1 | 4/2007 | Devos | |
| 2008/0231662 | A1 | 9/2008 | Brown et al. | |
| 2009/0303267 | A1 | 12/2009 | Silverbrook | |

(Continued)

FOREIGN PATENT DOCUMENTS

| | | |
|---|---|---|
| WO | WO-2013112168 | 8/2013 |
| WO | WO-2014003727 | 1/2014 |

OTHER PUBLICATIONS

Youngwan Cho; An Impact Position Control of the Ink Droplet of Inkjet Printer; Dept. of Computer Engineering, Seokyeong University, Seoul, Korea; Jun. 2-5, 2005.

*Primary Examiner* — An Do
(74) *Attorney, Agent, or Firm* — HP Inc. Patent Department

(57) ABSTRACT

In one example, a print bar structure includes a beam having two flanges connected by a web and a planar surface along a longitudinal edge of each flange, a printhead mounting structure attached to the beam along the planar surfaces to mount a printhead, and a fluid flow structure positioned between the flanges to carry printing fluid to the printhead mounting structure.

14 Claims, 7 Drawing Sheets

(56) References Cited

U.S. PATENT DOCUMENTS

| | | | |
|---|---|---|---|
| 2012/0019600 | A1 | 1/2012 | Arthur |
| 2012/0070217 | A1 | 3/2012 | Hendricks et al. |
| 2012/0019593 | A1 | 6/2012 | Scheffelin |

* cited by examiner 12
14
32
34
40
41
52
38
78
84
86
28
94
76
92
30
94
26
26
26
26
42
Z
Y
X

PRINT BAR STRUCTURE

BACKGROUND

In some inkjet printers, a stationary print bar with a media wide arrangement of printheads is used to print on paper or other print media moved past the printheads. In one type of print bar, elongated molded plastic parts support and carry printing fluid to the printheads.

DRAWINGS

The same part numbers are used to designate the same or similar parts throughout the figures.

DESCRIPTION

Figure 1:
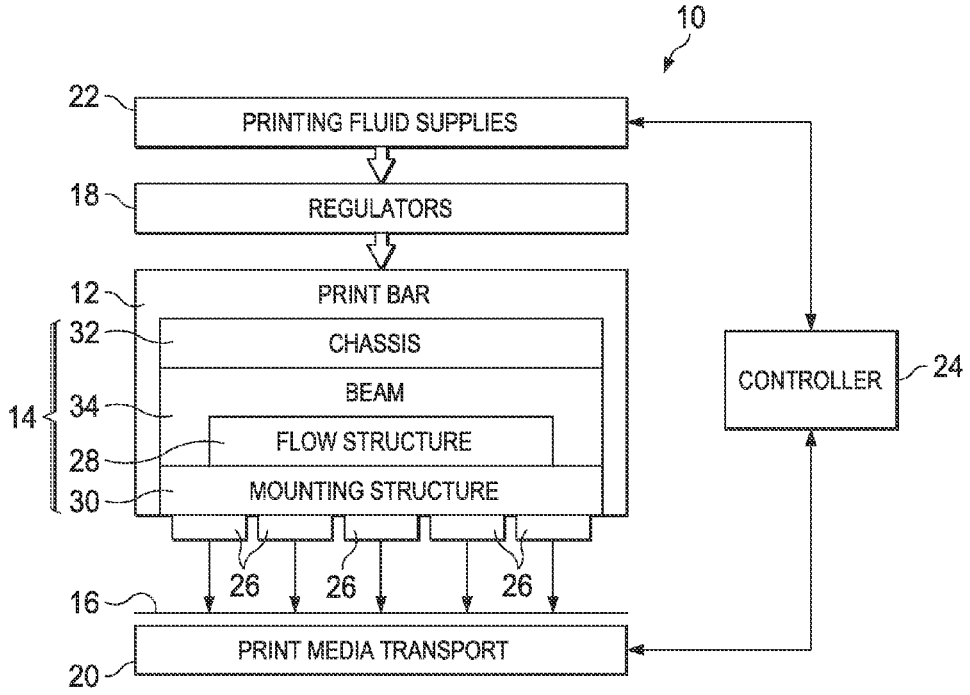
FIG. 1 is a block diagram illustrating an inkjet printer implementing one example of a print bar structure.

One of the challenges making print bars with molded plastic parts is precisely controlling the position of the printheads on the print bar to maintain the desired spacing and alignment between the printheads and the print media. Controlling the dimensions of plastic parts and keeping the parts flat for proper alignment is more difficult in longer parts. The length of the print bar corresponds the width of the print media. Thus, using longer parts for printing on wider media increases dimensional tolerances and the risk of misalignment.

A print bar structure disclosed in U.S. patent application Ser. No. 14/010,861 filed Aug. 27, 2013 was developed to help improve dimensional control in a media wide print bar by introducing a rigid chassis to support and constrain the molded plastic parts. In one example described the '861 application, a flange on a rigid, metal chassis is machined flat and sandwiched between plastic parts that support and carry printing fluid to the printheads to keep the parts flat and in the correct position. It has been discovered, however, that the flange in this sandwich configuration can deflect under heavy loads, allowing the printheads to move out of position. Also, sandwiching the chassis flange between plastic parts glued to one another but not to the flange is insufficient to keep the plastic parts flat under some printer operating conditions. Torsional loading on the print bar and thus deflection of the chassis is proportional to the cube of the length of the print bar. Consequently, it is particularly challenging to make the chassis stiff enough to resist torsional loads for printing on wider media, for example for printing on A3 size media (297 mm wide) compared to A4 size media (210 mm wide).

A new, stiffer print bar structure has been developed for media wide printing. In one example, the chassis includes a metal beam such as a C beam or an I beam with two flanges connected by a web. The elongated plastic structure that mounts the printheads is attached to the beam along a planar surface machined or otherwise formed on the edge of each flange. The flow structure that carries printing fluid to the printhead mounting structure is located between the flanges. Inlets to the flow structure protrude through holes in the web to receive printing fluid from the upstream supply system. The beam makes the chassis stronger and more rigid to help keep the printhead mounting structure flat even under the heavier loads on a longer chassis for printing on wider media.

This and other examples shown in the figures and described herein are non-limiting examples. Other examples are possible and nothing in this Description should be construed to limit the scope of the invention which is defined in the Claims that follow the Description.

As used in this document: a "beam" means a structure with two flanges connected by a web such as an I beam or a C beam (C beams are also commonly referred to as channels); "elongated" means a part is longer than it is wide; "room" means an extent of space occupied by or sufficient or available for something; a "printhead" means that part of an inkjet printer or other type of inkjet dispenser that dispenses fluid from one or more openings; and a "print bar" means a structure or device holding one or more printheads that remains stationary during printing. "Printhead" and "print bar" are not limited to printing with ink but also include inkjet type dispensing of other fluids and/or for uses other than printing.

Figure 2:
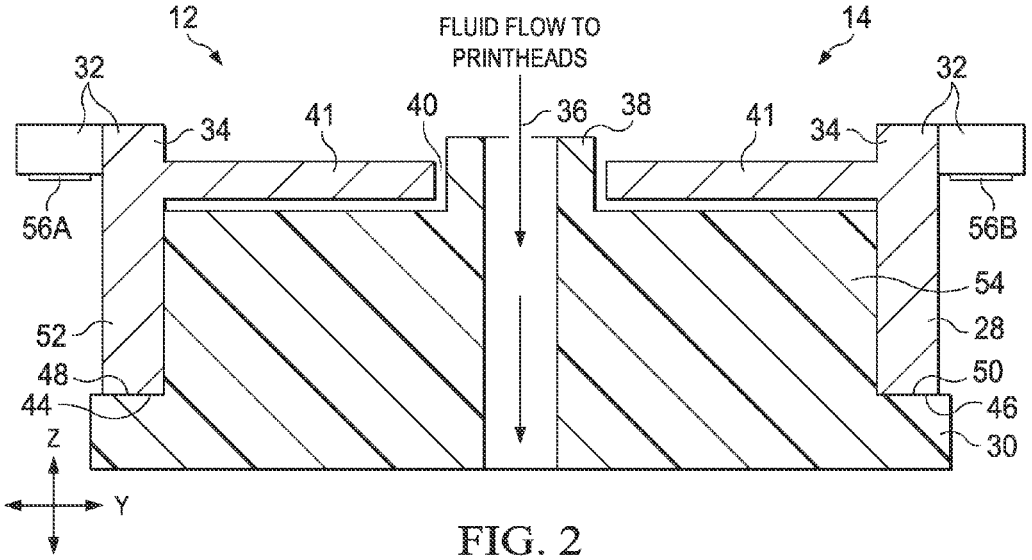
FIG. 2 is a diagrammatic partial section view illustrating an example of a print bar structure, such as might be used in the printer shown in FIG. 1.
Figure 3:
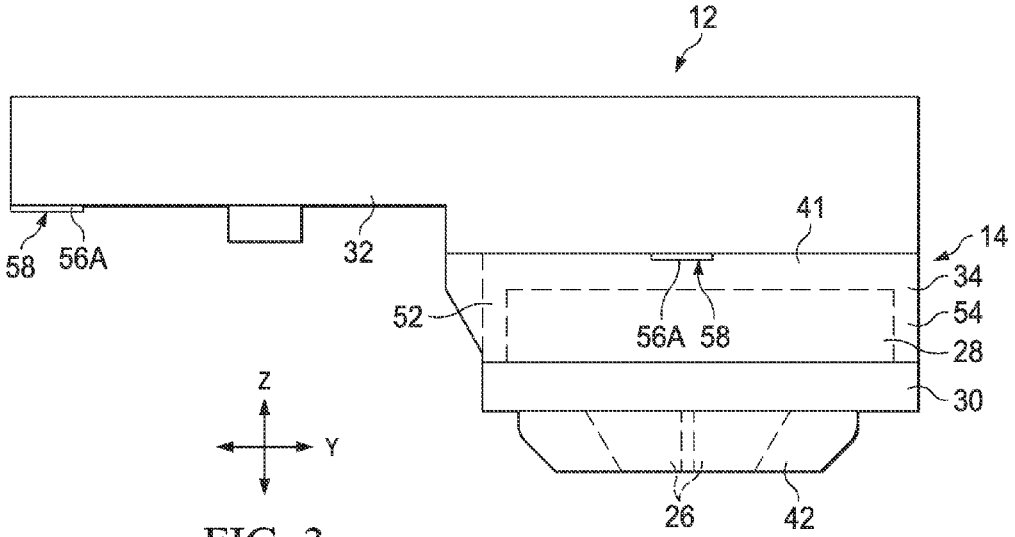
FIG. 3 is an end view of a print bar implementing one example of a print bar structure, such as the print bar structure shown in FIG. 2.
Figure 4:
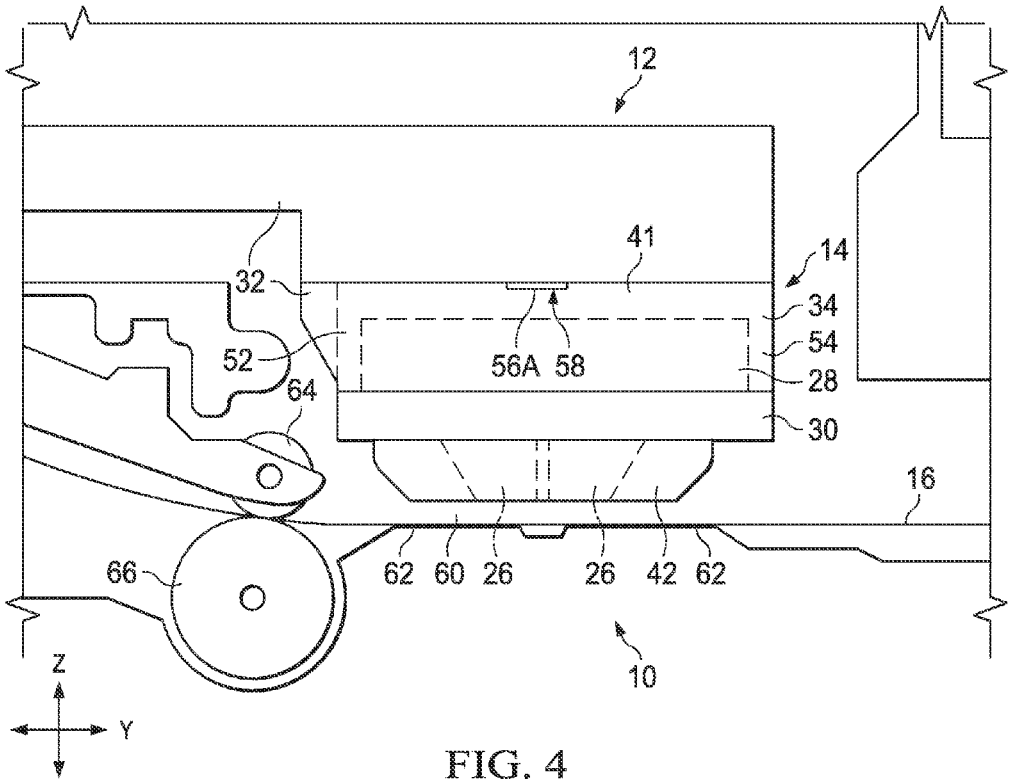
FIG. 4 is an end view illustrating the print bar of FIG. 3 installed in a printer showing the primary, Z direction spacing between the printheads and the print media.

FIG. 1 is a block diagram illustrating an inkjet printer 10 with a print bar 12 implementing one example of a new print bar structure 14 in which a beam on the chassis helps control the position and alignment of a printhead mounting structure. FIG. 2 is a diagrammatic partial section view illustrating one example of a print bar structure 14. FIG. 3 is an end view of a print bar 12 implementing one example of a print bar structure 14, such as the one shown in FIG. 2. FIG. 4 is an end view illustrating the print bar 12 of FIG. 3 installed in a printer showing the primary, Z direction spacing between the printheads and the print media.

Referring first to FIG. 1, printer 10 includes print bar 12 spanning the width of a print media 16, flow regulators 18 associated with print bar 12, a media transport mechanism 20, printing fluid supplies 22, and a printer controller 24. Print bar 12 in FIG. 1 includes an arrangement of multiple printheads 26 for ejecting ink or other printing fluid on to a sheet or continuous web of paper or other print media 16. Each printhead 26 is electrically connected to printer controller 24 and fluidically connected to one or more printing fluid supplies 22 through flow regulators 18 and a fluid flow structure 28 and printhead mounting structure 30 on print bar 12. Controller 24 in FIG. 1 represents generally the programming, processor(s) and associated memories, and the electronic circuitry and components needed to control the operative elements of printer 10. In operation, printer controller 24 selectively energizes dispensing elements in a printhead 26, or group of printheads 26, in the appropriate sequence to dispense printing fluid on to media 16 in a pattern corresponding to the desired printed image.

Referring now also to FIGS. 2-4, print bar structure 14 includes a chassis 32 having a beam 34 supporting flow structure 28 and printhead mounting structure 30. Fluid flows to printheads 26 from supplies 22 and flow regulators 18 through flow structure 28 and mounting structure 30, as indicated generally by a simplified flow path 36 in FIG. 2. In the example shown in FIG. 1, flow structure 28 and mounting structure 30 are separate parts. In the example shown in FIG. 2, flow structure 28 and mounting structure 30 are integrated into a single part that includes an inlet 38 to flow path 36 that protrudes through a hole 40 in the web 41 of beam 34.

A shroud 42 extends along the bottom of print bar 12, covering exposed portions of structure 30 and printheads 26 while leaving the face of each printhead 26 exposed for dispensing ink. Printhead mounting structure 30 is attached to a planar surface 44, 46 machined or otherwise formed on the edge 48, 50 of each flange 52, 54 of beam 34. Planar surfaces 44, 46 lie a plane that is parallel to a plane defined by reference surfaces 56A, 56B, 56C on chassis 32. Reference surfaces 56A, 56B, 56C establish three points of contact for mounting print bar 12 in printer 10 that form a primary, Z direction datum 58 to help maintain the desired spacing between printheads 26 and print media 16 during printing.

Figure 5:
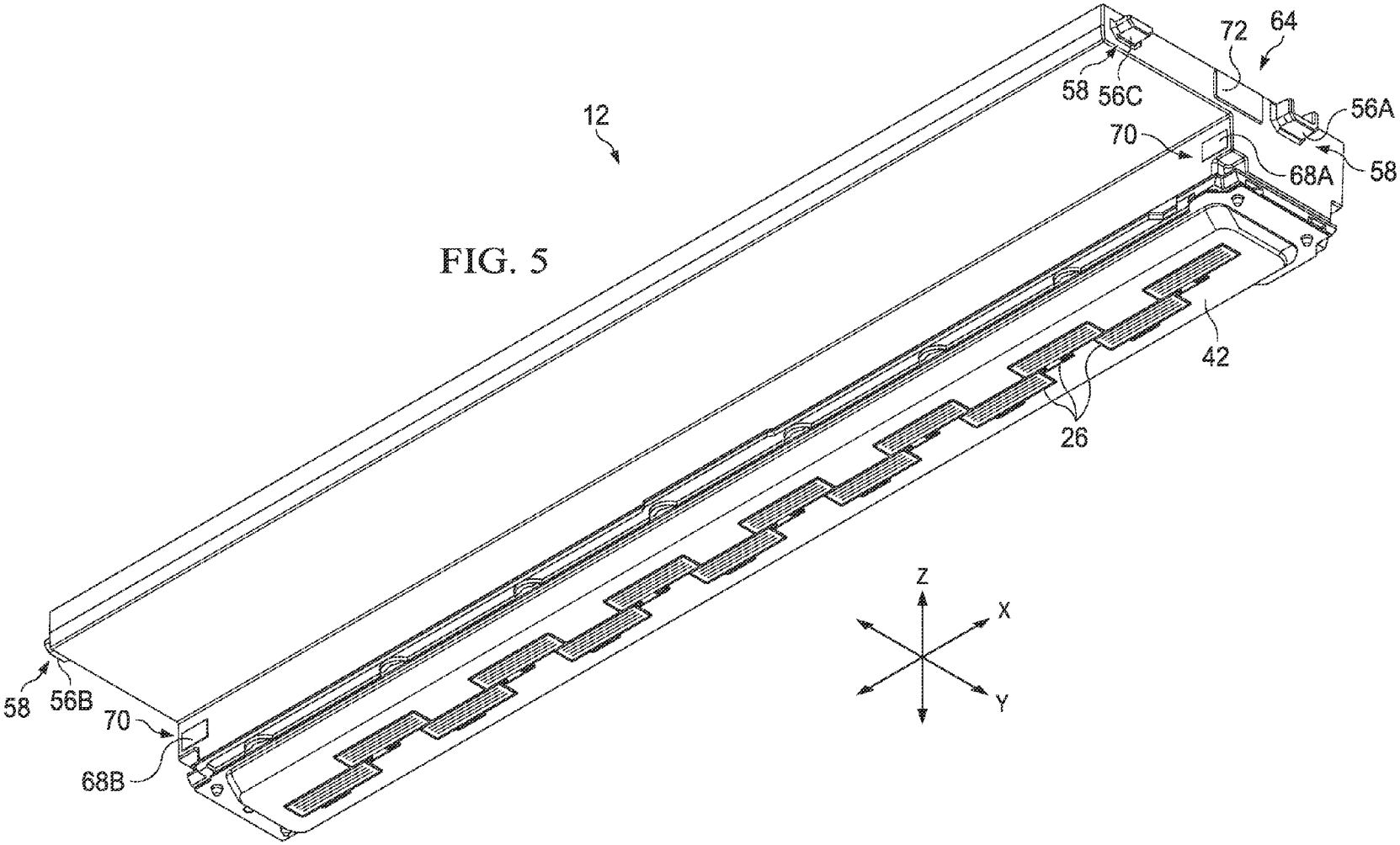
FIG. 5 is a perspective view of a print bar implementing one example of a print bar structure, viewed looking toward the exposed printheads.

Referring specifically to FIG. 4, print media 16 is moved through a print zone 60 between printheads 26 and a platen 62 at the urging of media transport rollers 64, 66. Z datum contact surfaces 56A-56C abut mating surfaces on the printer chassis (not shown) to establish the correct Z direction spacing between printheads 26 and platen 62 when print bar 12 is installed in printer 10, and thus help establish the correct spacing between printheads 26 and print media 16 during printing. Only two of the three Z datum contact surfaces are visible in FIG. 4. Six points of contact may be used to correctly position and fully constrain print bar 12 in all six degrees of freedom of motion. For example, as described below with reference to FIGS. 5-10, three points of contact 56A, 56B, 56C form a primary, Z datum 58 (FIGS. 5 and 6), two points contact 68A, 68B form a secondary, Y datum 70 (FIG. 5), and one point of contact 72 forms a tertiary, X datum 74 (FIG. 5). The three primary, Z datum contact points 56A-56C stop translation in the Z direction and rotation about the X and Y axes. The two secondary, Y datum points 68A and 68B stop translation in the Y direction and rotation about the Z axis. The single tertiary, X datum contact point 72 stops translation in the X direction.

Figure 6:
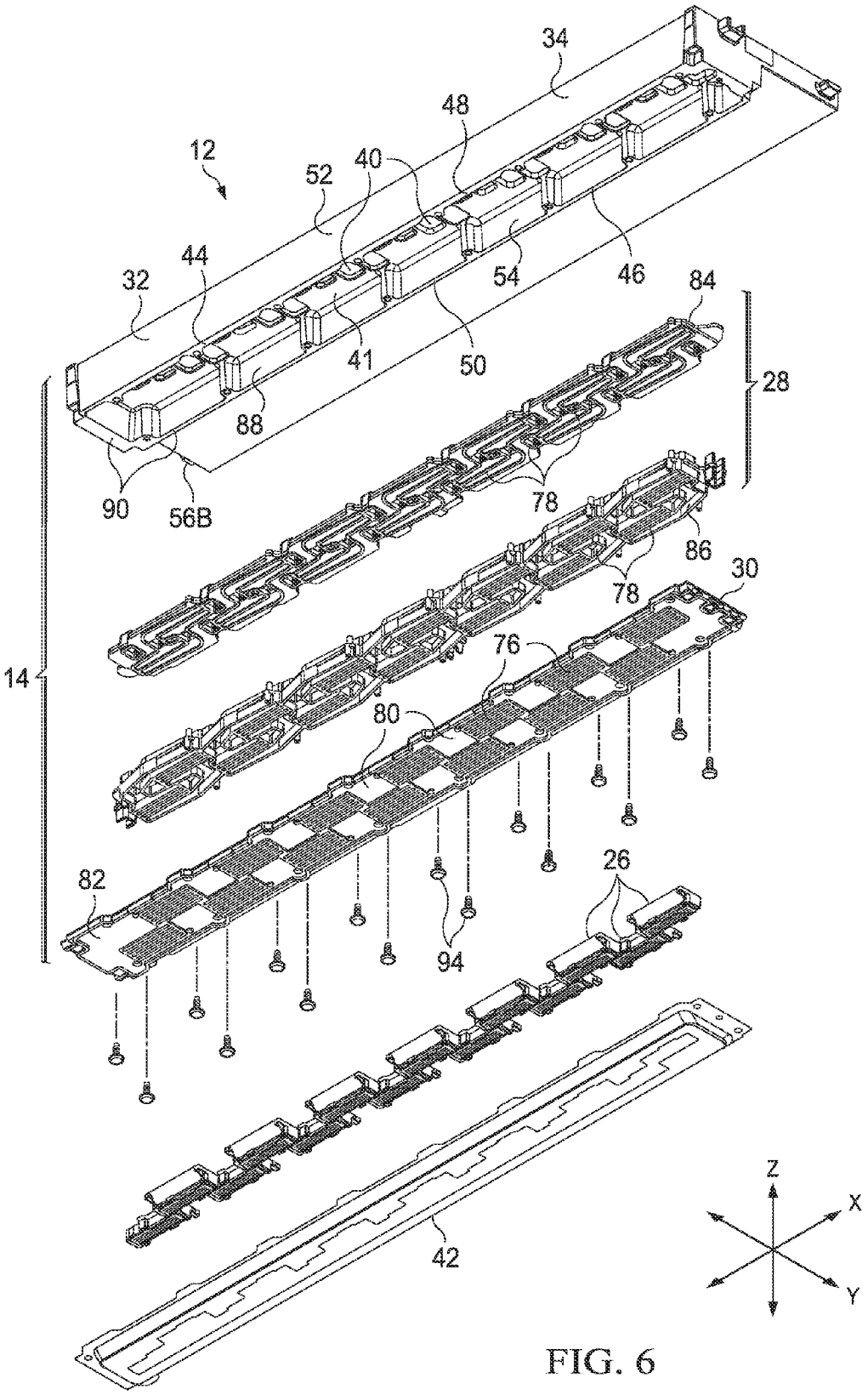
FIGS. 6 and 7 are exploded views of the print bar of FIG. 5.
Figure 7:
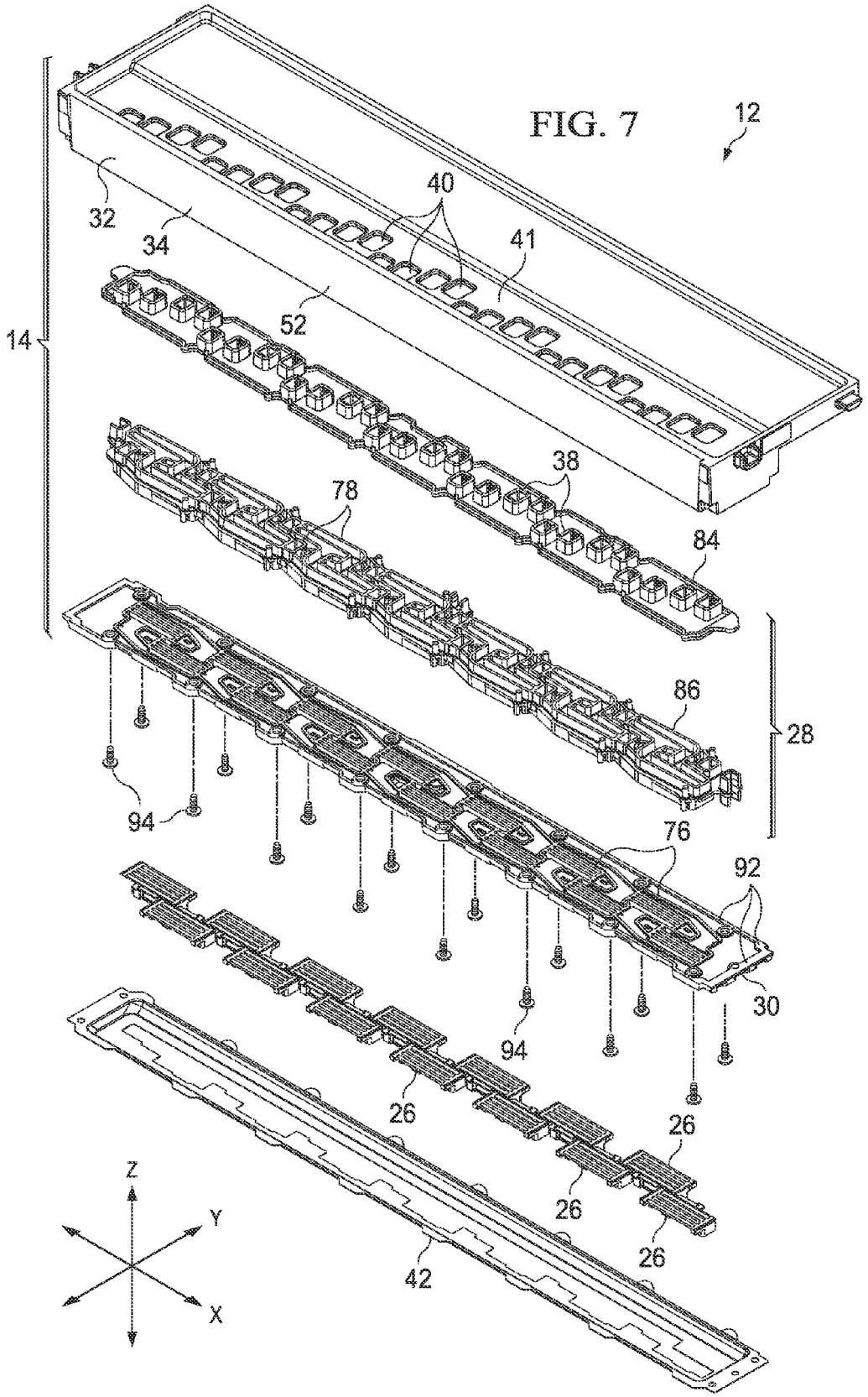
Figure 8:
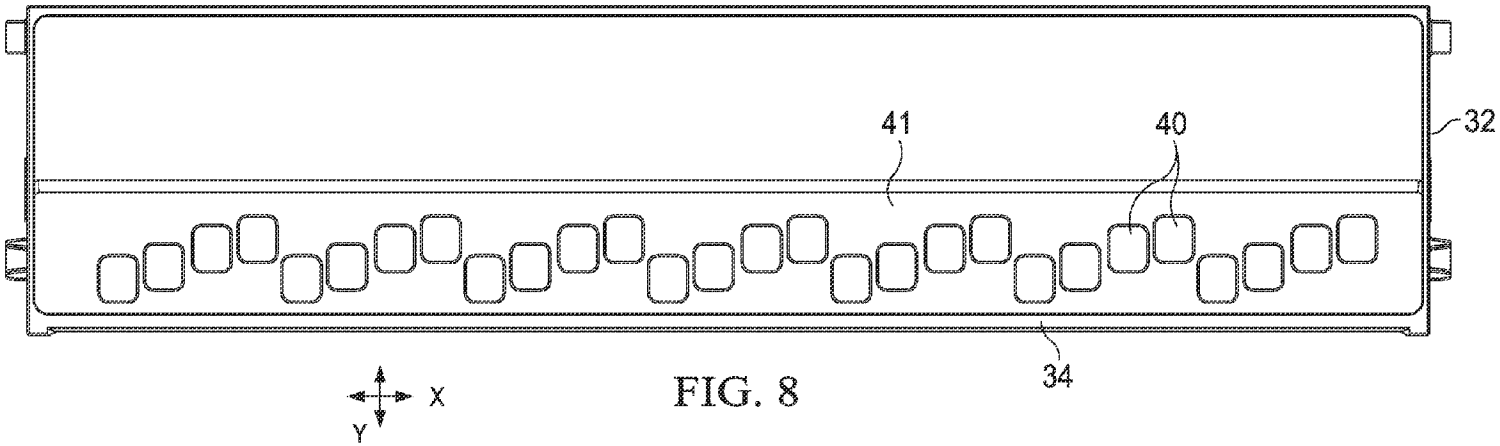
FIGS. 8 and 9 are top and bottom plan views, respectively, showing the chassis in the print bar structure in the print bar of FIGS. 5-7.

Referring now to the example of print bar 12 shown in FIGS. 5-10, printhead mounting structure 30 includes slots 76 that carry printing fluid to each printhead 26 from a corresponding set of conduits 78 in flow structure 28. In this example, fourteen printheads 26 are arranged generally end to end across the print bar in a staggered configuration in which each printhead overlaps as adjacent printhead. Mounting structure 30 may include groups of four slots 76 to carry printing fluid to each printhead 26, for example to print with C (cyan), M (magenta), Y (yellow) and K (black) ink. As shown in FIG. 6, each group of slots 76 in structure 30 is surrounded by a mounting surface 80 on the downstream face 82 of structure 30 for mounting printheads 26.

Figure 9:
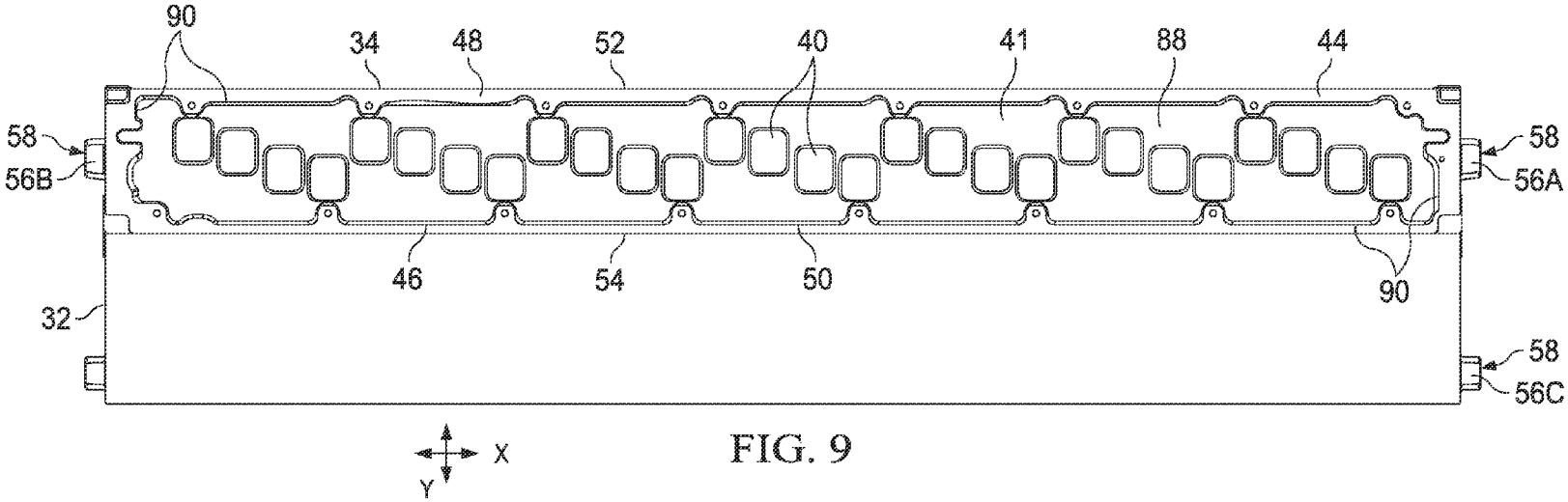
Figure 10:
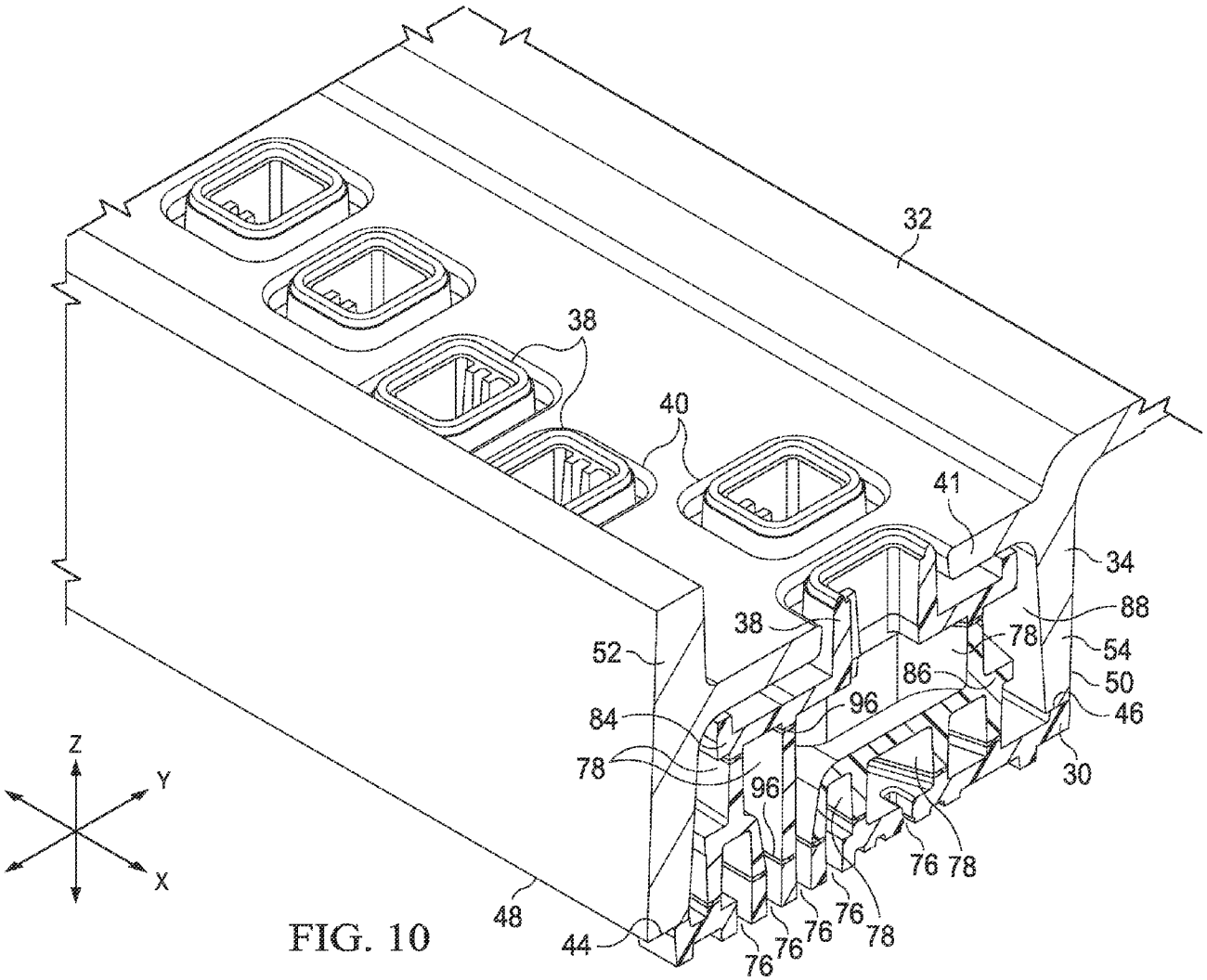
FIG. 10 is a section view of the print bar structure in the print bar of FIGS. 5-7.

In the example shown, flow structure 28 is configured as two discrete parts—an upstream flow structure 84 and a downstream flow structure 86, Also in this example, as best seen in FIG. 10, chassis beam 34 is configured as a C beam that forms an inverted tub 88 defined by flanges 52, 54 and web 41. The interior of beam 34 might alternately be characterized as a room 88 with a U-shaped cross section in which the walls and ceiling are formed by flanges 52, 54 and web 41, respectively, and the floor is formed by printhead mounting structure 30. Flow structures 84 and 86 are positioned in tub 88. Printhead mounting structure 30 is attached to planar alignment surfaces 44, 46 that extend along an exterior perimeter 90 of tub 88 on the edge 48, 50 of each flange 52, 54. Alignment surfaces 44, 46 may extend around each end of tub 88 to define a closed perimeter 90 as shown in FIGS. 6 and 9.

In one example, chassis 32 including beam 34 is aluminum and flow structures 84, 86 and printhead mounting structure 30 are molded plastic, Datum contact pads 72, 68A, 68B, and 56A-56C may be machined on to a cast aluminum chassis 32 to define X datum 74, Y datum 70, and Z datum 58. Each alignment surface 44, 46 may be machined on to the corresponding edge 48, 50 of each flange 52, 54 in an X-Y plane parallel to the X-Y plane defined by Z datum contact pads 56A-56C. While other suitable materials and processes may be used for chassis 32 (and specifically beam 34), it is expected that machined aluminum will be desirable for many implementations because it is readily machined with precision, sufficiently rigid to withstand the expected loading, and is comparatively inexpensive to cast and machine. Any suitable fastener may be used to hold the upstream face 92 of printhead mounting substrate 30 flat against planar alignment surfaces 44, 46 including, for example, adhesives or mechanical fasteners such as screws 94 shown in FIGS. 6 and 7. Any suitable fastener may be used to attach flow structures 84 and 86 to one another and to attach flow structure 86 to printhead mounting structure 30 including, for example, an adhesive 96 shown in FIG. 10.

A beam chassis 32 will be substantially more rigid than a comparably sized non-beam chassis such as that shown in the '861 application. Consequently, the print bar may be longer for printing on wider media while still maintaining an acceptable degree of deflection to help keep the printhead mounting structure flat even under the heavier loads on a longer chassis.

"A" and "an" as used in the claims means one or more.

The examples shown in the figures and described above illustrate but do not limit the invention. Other forms, details and examples may be made without departing from the spirit and scope of the invention which is defined in the following claims.

What is claimed is:

1. A print bar structure, comprising:

a beam having two flanges connected by a web and a planar surface along a longitudinal edge of each flange;

a printhead mounting structure attached to the beam along the planar surfaces to mount a printhead; and a fluid flow structure positioned between the flanges to carry printing fluid to the printhead mounting structure, the fluid flow structure being distinct from the beam.

2. The print bar structure of claim 1, wherein:

the beam comprises a metal beam;

the printhead mounting structure comprises an elongated plastic structure; and the flow structure comprises an elongated plastic structure attached to the printhead mounting structure.

3. The print bar structure of claim 2, wherein:

the plastic printhead mounting structure includes a downstream part to mount a printhead, an upstream part, and conduits through which printing fluid may flow from the upstream part to the downstream part, the printhead mounting structure attached to the beam such that the upstream part of the structure conforms to the planar beam surfaces; and the plastic flow structure includes an upstream part with inlets protruding through corresponding holes in the web, a downstream part attached to the upstream part of the printhead mounting structure, and conduits through which printing fluid may flow from the inlets to the downstream part.

4. The print bar structure of claim 3, wherein the upstream and downstream parts of the flow structure are discrete flow structures.

5. The print bar structure of claim 4, wherein:

the printhead mounting structure is attached to the beam with screws;

the downstream part of the flow structure and the printhead mounting structure are glued together; and the upstream and downstream parts of the flow structure are glued together.

6. The print bar structure of claim 1, wherein the printhead mounting structure and the flow structure are integrated into a single part.

7. A print bar structure, comprising:

a rigid elongated chassis having walls and a ceiling to form a room with a U-shaped cross section, the chassis having a datum defining a plane and a flat alignment surface parallel to the plane along an exterior perimeter of the room;

an elongated structure to mount a printhead, the printhead mounting structure affixed to the chassis flat against the alignment surface and spanning the walls to form a floor of the room; and an elongated fluid flow structure inside the room to carry printing fluid to the printhead mounting structure, the flow structure having conduits therein that each extend from an upstream part near the ceiling to a downstream part at the floor.

8. The print bar structure of claim 7, wherein each conduit extends from an inlet that protrudes through a hole in the ceiling at the upstream part to the downstream part.

9. The print bar structure of claim 7, wherein:

the printhead mounting substrate is affixed to the chassis along a perimeter of an upstream part of the printhead mounting substrate; and the downstream part of the flow structure is affixed to the upstream part of the printhead mounting structure.

10. The print bar structure of claim 9, wherein the flow structure includes multiple elongated parts glued together.

11. A print bar structure, comprising:

a printhead mounting structure;

a beam supporting the printhead mounting structure in a plane, the beam having a web and flanges forming an inverted tub; and a flow structure in the tub through which printing fluid may flow to the printhead mounting structure, the flow structure being distinct from the beam.

12. The print bar structure of claim 11, wherein the printhead mounting structure is affixed to a planar surface along a lengthwise edge of each of the flanges.

13. The print bar structure of claim 12, wherein the flow structure includes conduits through which printing fluid may flow to the printhead mounting structure with each conduit protruding through a corresponding hole in the web.

14. The print bar structure of claim 13, wherein the printhead mounting structure is plastic and the beam is metal.

* * * * *